US008714129B2

(12) United States Patent
Bauer

(10) Patent No.: US 8,714,129 B2
(45) Date of Patent: May 6, 2014

(54) PISTON FOR AN INTERNAL COMBUSTION ENGINE

(71) Applicant: Mahle International GmbH, Stuttgart (DE)

(72) Inventor: Valery Bauer, Waiblingen (DE)

(73) Assignee: MAHLE International GmbH, Stuttgart (DE)

( * ) Notice: Subject to any disclaimer, the term of this patent is extended or adjusted under 35 U.S.C. 154(b) by 0 days.

(21) Appl. No.: 13/769,939

(22) Filed: Feb. 19, 2013

(65) Prior Publication Data

US 2013/0160733 A1 Jun. 27, 2013

Related U.S. Application Data

(62) Division of application No. 12/734,241, filed as application No. PCT/DE2008/001696 on Oct. 17, 2008, now abandoned.

(30) Foreign Application Priority Data

Oct. 20, 2007 (DE) ..... 10 2007 050 213

(51) Int. Cl.
*F02F 3/16* (2006.01)

(52) U.S. Cl.
USPC ..... 123/193.6; 123/41.35

(58) Field of Classification Search
USPC ..... 123/193.6, 41.35; 92/208, 186
See application file for complete search history.

(56) References Cited

U.S. PATENT DOCUMENTS

| | | | | |
|---|---|---|---|---|
| 3,915,141 | A | 10/1975 | Öttl et al. | |
| 4,356,800 | A * | 11/1982 | Moebus | 123/193.6 |
| 4,614,150 | A | 9/1986 | Deutschmann | |
| 4,662,319 | A | 5/1987 | Ayoul | |
| 5,307,732 | A | 5/1994 | Berlinger | |
| 5,546,896 | A * | 8/1996 | Zaiser | 123/193.6 |
| 6,164,261 | A | 12/2000 | Kruse | |
| 6,223,710 | B1 | 5/2001 | Franz | |
| 6,401,680 | B1 | 6/2002 | Zhu et al. | |
| 6,532,913 | B1 | 3/2003 | Opris | |
| 6,651,549 | B2 * | 11/2003 | Zhu et al. | 92/186 |
| 6,698,391 | B1 | 3/2004 | Kemnitz | |

(Continued)

FOREIGN PATENT DOCUMENTS

| | | |
|---|---|---|
| DE | 26 48 392 | 4/1978 |
| DE | 29 36 630 | 3/1981 |

(Continued)

OTHER PUBLICATIONS

International Search Report of PCT/DE2008/001696, Mar. 23, 2009.

(Continued)

*Primary Examiner* — M. McMahon
(74) *Attorney, Agent, or Firm* — Collard & Roe, P.C.

(57) ABSTRACT

A multi-part piston for an internal combustion engine has a piston upper part and a piston lower part. The piston upper part comprises a piston head, a continuous fire land and a continuous ring part. The piston upper part and the piston lower part are connected together by securing means and form a continuous cooling channel. According to the invention, the connecting means connecting the piston upper part and the piston lower part are embodied as cooling elements that are arranged in the cooling channel and that are made of heating-conducting material.

10 Claims, 2 Drawing Sheets

(56) References Cited

U.S. PATENT DOCUMENTS

| | | | | |
|---|---|---|---|---|
| 6,920,860 | B2 * | 7/2005 | Gabriel et al. | 123/193.6 |
| 7,603,977 | B2 | 10/2009 | Heidrich et al. | |
| 8,267,005 | B2 | 9/2012 | Scharp et al. | |
| 2002/0178910 | A1 * | 12/2002 | Keller et al. | 92/208 |
| 2006/0283417 | A1 | 12/2006 | Yaguchi et al. | |
| 2007/0137605 | A1 | 6/2007 | Scharp | |
| 2008/0121102 | A1 | 5/2008 | Scharp et al. | |
| 2011/0226211 | A1 | 9/2011 | Messmer | |
| 2013/0104838 | A1 * | 5/2013 | Spangenberg | 123/193.6 |

FOREIGN PATENT DOCUMENTS

| | | |
|---|---|---|
| DE | 32 05 173 | 8/1983 |
| DE | 34 26 238 | 1/1986 |
| DE | 102 44 512 | 4/2004 |
| DE | 10 2004 038 9 | 2/2006 |
| DE | 10 2004 057 6 | 6/2006 |
| DE | 10 2005 060 6 | 6/2007 |
| FR | 1 301 299 | 8/1962 |
| GB | 2 384 541 | 7/2003 |

OTHER PUBLICATIONS

German Search Report dated May 15, 2008 in German Application No. 10 2007 050 213.5 along with an English translation of the relevant parts.

* cited by examiner

PISTON FOR AN INTERNAL COMBUSTION ENGINE

CROSS REFERENCE TO RELATED APPLICATIONS

This application is a divisional of and Applicants claim priority under 35 U.S.C. §§120 and 121 of U.S. application Ser. No. 12/734,241 filed on Sep. 2, 2010, which application is a national stage application under 35 U.S.C. 371 of PCT Application No. PCT/DE2008/001696 filed on Oct. 17, 2008, which claims priority under 35 U.S.C. §119 from German Patent Application No. 10 2007 050 213.5 filed on Oct. 20, 2007, the disclosures of each of which are hereby incorporated by reference. A certified copy of priority German Patent Application No. 10 2007 050 213.5 is contained in parent U.S. application Ser. No. 12/734,241. The International Application under PCT article 21(2) was not published in English.

BACKGROUND OF THE INVENTION

The present invention relates to a multi-part piston for an internal combustion engine, having an upper piston part and a lower piston part, whereby the upper piston part has a piston crown, a circumferential top land, as well as a circumferential ring belt, whereby the upper piston part and the lower piston part are connected with one another by means of attachment means and form a circumferential cooling channel.

In the case of such known multi-part cooling channel pistons, the problem exists of reliably connecting the upper piston part and the lower piston part with one another, while avoiding stresses. Furthermore, optimization of the cooling effect of the cooling oil contained in the cooling channel is aimed at. The cooling oil circulates in the cooling channel and is moved as a result of the shaker effect that is brought about by the piston movement. In DE 102 44 512 A1, it is proposed to provide the circumferential cooling channel with bores that are directed toward the piston crown, in order to achieve a better distribution of the cooling oil. However, in the case of pistons that are subject to great stress, in particular, the heat dissipation brought about by the movement of the cooling oil is not sufficient.

The present invention is therefore based on the task of creating a multi-part piston of the type indicated, having an improved cooling effect of the cooling oil that circulates in a cooling channel, in which piston the upper piston part and the lower piston part are reliably connected with one another.

SUMMARY OF THE INVENTION

To accomplish this task, the present invention comprises a multi-part piston having attachment means that connect the upper piston part and the lower piston part. The attachment means are configured as cooling elements made of a heat-conductive material and disposed in the cooling channel.

The piston according to the invention is characterized by an improved cooling effect, which has several causes. The cooling elements represent an additional cooling surface in the cooling space, by way of which the heat transported from the piston crown to the cooling elements is given off to the cooling oil that flows around the cooling elements. Furthermore, a directed flow of heat from the piston crown to the cooling oil, by way of the cooling elements, is guaranteed, and this, in particular, quickly and reliably reduces the heat stress on the piston crown, which faces the combustion chamber. In addition, heat dissipation from the cooling element into the lower piston part takes place. In the case of pistons whose piston crown is provided with a combustion chamber bowl, the bowl edge, in particular, is relieved of stress in particularly effective manner in this way.

The attachment means, which are configured as cooling elements, are uniformly distributed in a radially outer region of the piston, i.e. in the immediate vicinity of the ring belt, namely in the circumferential cooling channel, so that a particularly low-stress and reliable connection of upper piston part and lower piston part is achieved. Furthermore, the attachment means, which are configured as cooling elements, bring about an improvement in the shape stability of the piston according to the invention. For this reason, it is possible to configure the piston according to the invention, despite the cooling elements that are provided, in such a manner that a weight increase in comparison with conventional pistons is avoided. This can be brought about in that on the one hand, a suitable material, having as low a density as possible, is selected for the cooling elements, and that on the other hand, the wall thicknesses, particularly between the circumferential cooling channel and the adjacent structural elements, can be reduced because of the improved shape stability. In the case of a suitable method of construction, a weight reduction in comparison with conventional pistons is actually possible.

The embodiment according to the invention is suitable for all types of multi-part pistons, and allows a plurality of variants with regard to material selection and design. The piston according to the invention can consist, for example, of steel, cast iron, light metal, as well as a combination of these materials, and it can be configured with or without oil injection, for example.

Every cooling element, i.e. every attachment means configured as a cooling element, is accommodated in two recesses, one of which is provided in the upper piston part, and one in the lower piston part. The recesses provided in the lower piston part can be configured, for example, as dead-end bores or as passage bores. Therefore the cooling elements can be inserted into the upper piston part or the lower piston part, for example, in simple manner, if necessary oriented in known manner, using a centering ring, and the missing piston part can be pushed onto the cooling elements, so that these engage into the corresponding bores. Attachment of the cooling elements preferably takes place by means of press fit or shrink fit.

The recesses provided in the upper piston part in this embodiment bring about a further reduction in material thickness toward the piston crown. In a particularly advantageous embodiment, the material thickness toward the bowl edge is reduced if the piston crown is provided with a combustion chamber bowl. This brings about a further improved and accelerated transport of heat to the cooling elements. The cooling elements simultaneously ensure sufficient shape stability of the piston according to the invention, in that the cooling elements balance out possible stability losses brought about by the recesses. This has the result that the diameter of a combustion chamber bowl provided in an individual case can be further increased as compared with the state of the art. This in turn once again improves the heat dissipation in the direction of the cooling elements, and from there to the cooling oil. The number of cooling elements can be selected to be particularly large, because of the improved shape stability, so that the effective cooling surface is optimized. In addition, the heat taken up by the piston crown is prevented from penetrating into the region of the ring belt.

Another suitable embodiment provides for ring-shaped cooling elements, which can be provided with passage openings for the cooling oil, if necessary, in order to optimize mixing of the cooling oil. A particularly preferred embodiment of the piston according to the invention consists in that pin-shaped cooling elements are provided. This configuration is accompanied by the greatest possible increase in the cooling surface, so that particularly effective heat dissipation from the cooling elements to the cooling oil takes place.

The cooling elements are preferably configured as solid metal cooling elements, and consist, for example, of copper, aluminum, or their alloys.

In a preferred embodiment, the upper piston part and the lower piston part additionally form an inner cooling chamber, which is separated from the circumferential cooling channel by a circumferential partition, to support the cooling effect. The upper piston part and the lower piston part can have additional connection elements in the region of the partition, which support the connection of upper piston part and lower piston part. These connection elements also can be configured as cooling elements, to further improve the cooling effect.

In an advantageous manner, the partition can have at least two overflow openings for cooling oil, which connect the circumferential cooling channel and the inner cooling chamber with one another, in order to optimize mixing of the cooling oil.

The materials for the upper piston part and the lower piston part can be selected and combined with one another as desired. For example, steel materials and light-metal materials are suitable.

BRIEF DESCRIPTION OF THE DRAWINGS

Exemplary embodiments of the invention will be described in the following, using the attached drawing. The drawing shows, in a schematic representation, not true to scale.

DETAILED DESCRIPTION OF THE EMBODIMENTS

Figure 1:
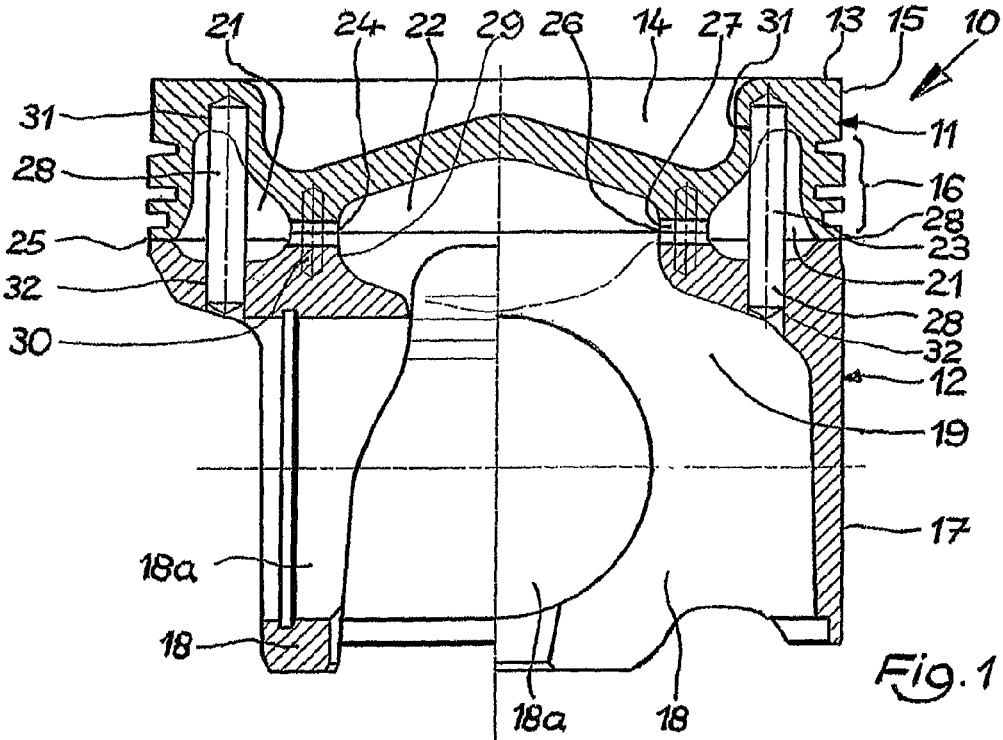
FIG. 1 a section through a first exemplary embodiment of a piston according to the invention.
Figure 2:
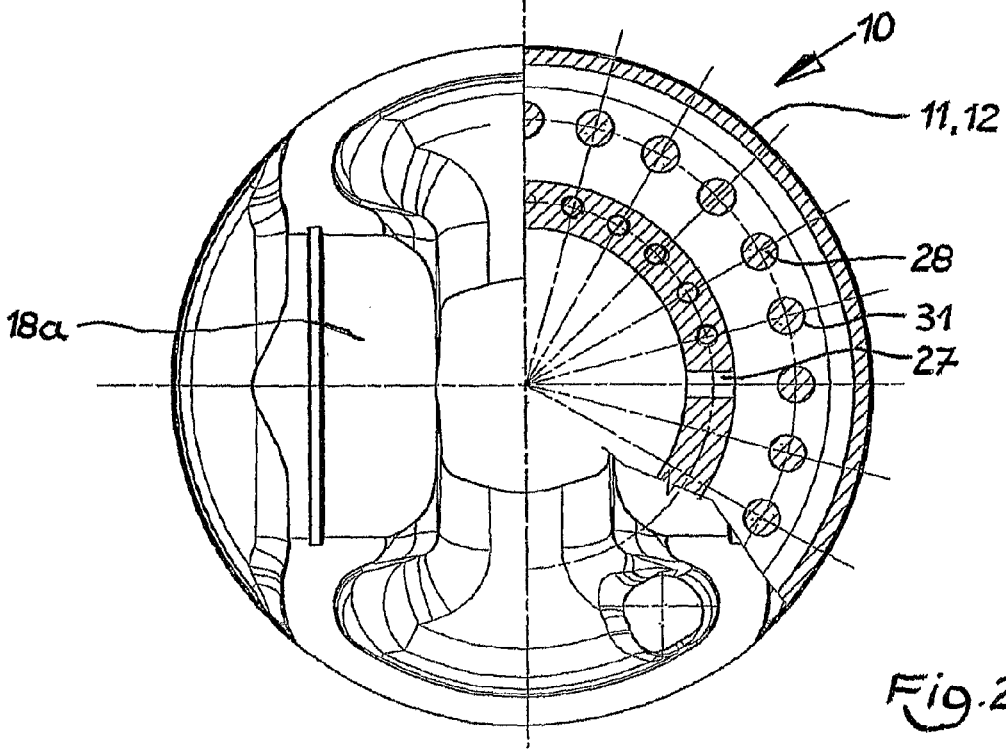
FIG. 2 the piston according to FIG. 1 in a top view, partly in section.

FIGS. 1 and 2 show a first exemplary embodiment of a piston 10 according to the invention, whereby the representation according to FIG. 1 is rotated by 90° in the left half, as compared with the representation in the right half.

The piston 10 according to the invention is composed of an upper piston part 11 and a lower piston part 12. The upper piston part 11 has a piston crown 13 having a combustion chamber bowl 14 as well as a side wall having a circumferential top land 15 and a circumferential ring belt 16 for accommodating piston rings (not shown). The lower piston part 12 has a piston skirt 17, pin bosses 18 having pin bores 18*a* for accommodating a piston pin (not shown), and pin boss supports 19 that are connected with the piston skirt 17. The upper piston part 11 and the lower piston part 12 form a circumferential outer cooling channel 21 and an inner cooling chamber 22, which are separated from one another by means of a partition 29. In the exemplary embodiment, overflow channels 27 are provided in the partition 29, which connect the cooling channel 21 and the cooling chamber 22 with one another.

The upper piston part 11 has an outer contact surface 23 that follows the ring belt 16, and a ring-shaped, circumferential inner support surface 24 on its underside. The lower piston part 12 also has an outer contact surface 25 on its top, as well as a ring-shaped, circumferential inner support surface 26. In the assembled state, the upper piston part 11 and the lower piston part 12 are oriented, relative to one another, in such a manner that the two support surfaces 24, 26 as well as the two contact surfaces 23, 25 lie against one another. The partition 29 is formed in the region of the support surfaces 24, 26, in the assembled state.

The materials of the upper piston part 11 and the lower piston part 12 can be selected and combined with one another as desired, for example hot steel, AFP steel, or light-metal alloys, particularly aluminum alloys. For example, the upper piston part 11 can be forged from hot steel, and the lower piston part 12 can be forged from AFP steel; however, the upper piston part 11 can also be forged from AFP steel, and the lower piston part 12 can be cast from an aluminum alloy. However, the upper piston part 11 can also be forged from an aluminum alloy, and the lower piston part can be cast from an aluminum alloy.

In the exemplary embodiment, a plurality of pin-shaped attachment means configured as cooling elements 28 are disposed in the cooling channel 21 of the piston 10. The cooling elements 28 consist of a material that conducts heat well, preferably having a low density. Metallic materials such as aluminum, copper, or their alloys, for example, are suitable. The free ends of the cooling elements 28 are accommodated in recesses 31, 32 configured as bores. The recess 31, configured as a dead-end bore, is disposed in a wall section of the cooling channel 21 formed by the upper piston part 11, and is directed toward the piston crown 13. The recess 32, configured as a passage bore, is disposed in a wall section of the cooling channel 21 formed by the lower piston part 12. The cooling elements 28 are attached in the upper piston part 11 and in the lower piston part 12 by means of a press fit or shrink fit, in the exemplary embodiment.

The cooling elements 28 are therefore simultaneously attachment means, by means of which the upper piston part 11 and the lower piston part 12 are connected with one another essentially without any tension. This is attributable to the fact that the attachment means are disposed, uniformly distributed, in a radially outer region of the piston 10, i.e. in the immediate vicinity of the ring belt 15, namely in the circumferential cooling channel 21. Furthermore, the attachment means, which are configured as cooling elements 28, bring about an improvement in the shape stability of the piston 10 according to the invention. For this reason, the wall thickness between the combustion chamber bowl 14 and the recesses 31 is configured to be particularly small. This is accompanied by a reduction in material and weight. Furthermore, the heat from the combustion chamber bowl 14 is passed off to the cooling elements 28 particularly quickly.

The surfaces of the numerous cooling elements 28 act as an additional large cooling surface in the cooling channel 21. By way of this cooling surface, the heat transport from the piston crown 13 to the cooling elements 28 is given off to the cooling oil that flows around the cooling elements 28 particularly quickly. Furthermore, a direct heat flow from the piston crown 13 to the cooling channel 21, and from there both to the cooling oil and to the lower piston part 12, is guaranteed, and this reduces the heat stress on the piston crown 13 and on the bowl edge of the combustion chamber bowl 14, in particular, in particularly effective manner.

In the exemplary embodiment shown in FIG. 1, pin-shaped connection elements 30 are furthermore provided in the partition 29, which elements, comparable to the attachment means configured as cooling elements 28, are accommodated in recesses provided in the upper piston part 11 and the lower piston part 12, respectively, for example by means of press fit or shrink fit. The connection elements 30 support the connection between the upper piston part 11 and the lower piston part 12 brought about by the attachment elements configured as cooling elements 28. The connection elements 30 can also be configured as cooling elements, in order to support the heat dissipation from the piston crown 13 to the lower piston part 12.

Figure 3:
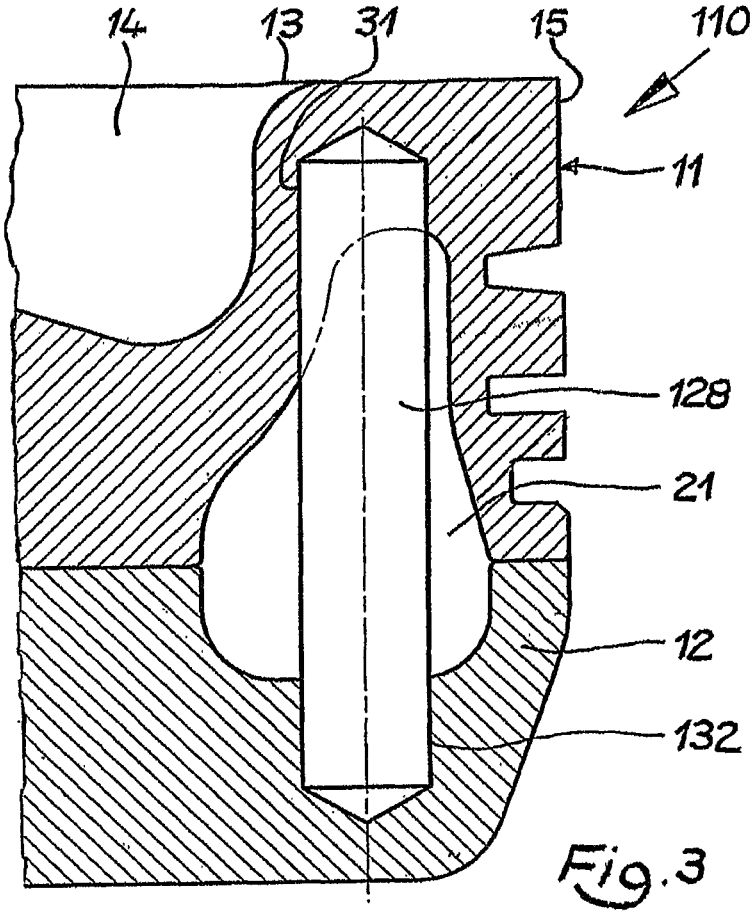
FIG. 3 an enlarged detail of a second exemplary embodiment of a piston according to the invention, in section.

FIG. 3 shows, as a detail, another exemplary embodiment of a multi-part piston 110, whereby the same reference symbols were used for the same components. In FIG. 3, only part of the upper piston part 11 and part of the lower piston part 12, as well as the cooling channel 21 and a cooling element 128 are shown. The piston 110 has the same structure as the piston 10 shown in FIG. 1. The only difference consists in that the lower free ends of the cooling elements 128 are accommodated in recesses 132 provided in the lower piston part 12 and configured as dead-end bores. The upper, free ends of the cooling elements 128 are accommodated in recesses 31 configured as dead-end bores, which are provided in the upper piston part 11, just as in the piston 10. In this exemplary embodiment, too, the cooling elements 128 can be attached by means of press fit or shrink fit. The cooling elements 128 have the same effects and advantages as those described for the cooling elements 28 according to FIG. 1.

Figure 4:
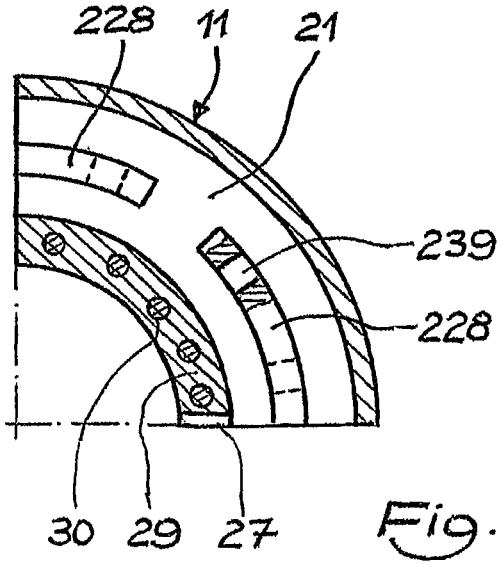
FIG. 4 an enlarged detail of an upper piston part for a third exemplary embodiment of a piston according to the invention, in section.

FIG. 4 shows, as a detail, another exemplary embodiment of an upper piston part 11 of a multi-part piston 210, which is the same as the piston 10 and 110 shown in FIGS. 1 and 3, respectively. It can be seen that connection elements 30 are disposed in the region of the partition 29. The only difference consists in that in place of pin-shaped cooling elements, cooling elements 228 configured in the shape of ring segments are provided. The upper free ends of the cooling elements 228 are accommodated, in comparable manner, in recesses (not shown), which are disposed in a wall section of the cooling channel 21 formed by the upper piston part 11. The cooling elements 228 are attached in suitable manner, as described above, for example by means of shrink fit or press fit. In the assembled state, the lower free ends of the cooling elements 228 are accommodated and attached in recesses (not shown) provided in the lower piston part, in comparable manner. The cooling elements 228 have passage openings 239, in order to guarantee optimal mixing of the cooling oil accommodated in the cooling channel 21. The cooling elements 228 demonstrate the same effects and advantages as described for the cooling elements 28 according to FIG. 1.

The invention claimed is:

1. A multi-part piston for an internal combustion engine, comprising:

an upper piston part having a piston crown, a circumferential top land and a circumferential ring belt; and a lower piston part, wherein the upper piston part and the lower piston part are connected with one another by attachment means and form a circumferential cooling channel, and wherein the attachment means that connect the upper piston part and the lower piston part are configured as cooling elements in the shape of ring segments made of a heat-conductive material and disposed in the cooling channel.

2. The piston according to claim 1, wherein every cooling element is accommodated in a recess provided in the upper piston part and in a recess provided in the lower piston part.

3. The piston according to claim 2, wherein the cooling elements are accommodated in the recesses by means of press fit or shrink fit.

4. The piston according to claim 1, wherein the cooling elements have passage openings for cooling oil.

5. The piston according to claim 1, wherein the cooling elements are configured as solid metal cooling elements made of copper, aluminum, or their alloys.

6. The piston according to claim 1, wherein the upper piston part and the lower piston part form an inner cooling chamber, which is separated from the circumferential cooling channel by a circumferential partition.

7. The piston according to claim 6, wherein the upper piston part and the lower piston part have connection elements in a region of the partition, which connect the upper piston part and the lower piston part with one another.

8. The piston according to claim 7, wherein the connection elements are configured as cooling elements.

9. The piston according to claim 6, wherein the partition has at least two overflow channels for cooling oil, which connect the circumferential cooling channel and the inner cooling chamber with one another.

10. The piston according to claim 1, wherein at least one of the upper piston part and the lower piston part consists of a steel material or a light-metal material.

* * * * *